US006581771B2

(12) United States Patent
McDade

(10) Patent No.: US 6,581,771 B2
(45) Date of Patent: Jun. 24, 2003

(54) STACK AND NEST BAIL CONTAINER

(75) Inventor: Clinton McDade, Charlotte, NC (US)

(73) Assignee: Schaefer Systems International, Inc., Charlotte, NC (US)

( * ) Notice: Subject to any disclaimer, the term of this patent is extended or adjusted under 35 U.S.C. 154(b) by 42 days.

(21) Appl. No.: 10/002,717

(22) Filed: Oct. 24, 2001

(65) Prior Publication Data

US 2003/0075472 A1 Apr. 24, 2003

(51) Int. Cl.[7] ..... B65D 21/04
(52) U.S. Cl. ..... 206/505
(58) Field of Search ..... 206/505, 506, 206/507, 508, 513, 518, 519, 515

(56) References Cited

U.S. PATENT DOCUMENTS 2,112,451 A * 3/1938 Best et al. ..... 206/506
4,947,992 A * 8/1990 Schafer ..... 206/506
5,494,163 A * 2/1996 Apps ..... 206/506
5,609,254 A 3/1997 Loftus et al.
5,924,572 A * 7/1999 Cope ..... 206/518
6,059,114 A 5/2000 Loftus
6,089,373 A 7/2000 Cope
6,145,664 A 11/2000 Cope

* cited by examiner

*Primary Examiner*—Stephen Castellano
(74) *Attorney, Agent, or Firm*—Adams Evans P.A.

(57) ABSTRACT

A container for storing items and adapted for being stacked upon and nested within like containers. The container includes a base. First and second pairs of spaced-apart, opposing sidewalls extend upwardly and outwardly from the base. The second pair of sidewalls is perpendicularly disposed between and interconnects the first pair of sidewalls to form a storage compartment. The container also includes first and second pairs of opposed support members. Each of the pairs of support members is pivotally connected to a respective one of the opposing sidewalls and is adapted for being moved between an inwardly-directed position residing within the storage compartment at a predetermined vertical position therein and an outwardly-directed position residing exterior to the storage compartment for defining a nesting position, a first stacking position, and a second stacking position.

15 Claims, 7 Drawing Sheets

STACK AND NEST BAIL CONTAINER

TECHNICAL FIELD AND BACKGROUND OF THE INVENTION

This invention relates to a storage container, particularly one which has both stacking and nesting capabilities. Known as "stack and nest" containers, such containers are commonly used in retail and food distribution businesses, and are particularly suited for distribution applications requiring containers that exhibit great stacking strength when full, yet provide efficient, space-saving storage when empty.

Traditional prior art stack and nest containers are typically designed as "180° stack and nest" containers, or as "two-bail" containers. A standard 180° stack and nest container has opposing sidewalls shaped so that the containers may be selectively moved between stacked and nested positions depending upon the orientation of the sidewalls of one container relative to the sidewalls of another like container. Such containers rely upon superposable ledge structures that are formed on opposing sidewalls for permitting one container to be nested within another container so that the superposable ledge structures coincide and maintain the containers in the nesting position. To stack such containers, the uppermost container is removed from the container within which it was nested and rotated 180°. This 180° rotation reorients the sidewalls and ledge structures of the containers relative to each other so that the ledge structures no longer nest with each other, but instead engage each other, thereby permitting the containers to be stacked.

While the design of 180° stack and nest containers is simple and straightforward, such containers possess certain disadvantages. Although the ledge structures on the opposing sidewalls are dissimilar in form, the visual appearance of the structures is so similar that it is often difficult for workers to properly distinguish which way to rotate the containers for proper nesting or stacking. Improperly rotating a container filled with food or other products so that the container in the nested position, rather than the stacked position can result in damaged goods. Furthermore, individuals rotating the containers are placed at a greater risk for injuries, including but not limited to injuries to the upper torso or lower back, caused by manually rotating loaded containers prior to stacking the containers on top of each other.

Although two-bail stack and nest containers eliminate many of the problems associated with 180° stack and nest containers, two bail containers also have limitations. Each of the bails on a two-bail container is positioned adjacent to the upper edge of a respective one of the opposing sidewalls on the container, and may be moved between a stacking orientation in which the bail extends across the top of the container adjacent one side for permitting a like container to be stacked on top of the bail, and a retracted orientation in which the bail is positioned along the exterior of the sidewalls of the container. Although two-bail containers permit stacking and nesting of like containers, such containers are capable of being stacked at only one height relative to each other.

The invention of the present application addresses the limitations found in 180° stack and nest containers and two-bail containers by providing a unique container that employs four bails instead of only two, and is capable of being nested within another like container or stacked with other like containers in one of at least two positions without requiring that any of the containers so nested or stacked be rotated prior to changing the positions. This novel four-bail container provides an alternative to conventional stack and nest containers, and is easy to use. Specifically, the four-bail container of the present invention includes one pair of bails, each of which is positioned adjacent to the upper edge of a respective one of two opposing sidewalls on the container. A second pair of bails is also included. Each of the second pair of bails is positioned on a superposable ledge structure formed on the interior of a respective one of the other two opposing sidewalls of the container. The bails may be arranged in a number of orientations relative to one another and to the container for permitting the container to be nested with one or more like containers, or stacked with one or more like containers in one of at least two stacking heights.

The four bale container of the present invention eliminates the ergonomic health issues associated with 180° containers by eliminating the need to rotate the containers. In addition, because the four bale container does not need to be rotated, the containers are easier to label. Labeling one side of the container is necessary to allow the container to be presented to an automated reader or otherwise visually inspected. Because the container of the present invention does not need to be rotated in order to change its stacking height, once one side of the container is labeled, the labeled side will not disappear from view. Furthermore, the bails are mounted for pivotal movement relative to the container, which permits the bail pairs to be quickly and easily "flipped" from one position to another. The bails are also positioned within the container in a manner which permits easy visual inspection of the bail positions.

SUMMARY OF THE INVENTION

Therefore, it is an object of the invention to provide a stack and nest container which can be interstacked and internested with other like containers to form a stable, unitary load regardless of whether the containers are full or empty.

It is another object of the invention to provide a stack and nest container which eliminates the need to rotate the container to achieve a stacking or nesting position with respect to another like container.

It is another object of the invention to provide a stack and nest container which can be selectively moved between a nested position and one of at least two stacked positions for permitting the height of the interior storage area of the container to be adjusted according to storage requirements without requiring that the container be rotated.

It is another object of the invention to provide a stack and nest container which may be easily positioned and maintained in either a stacked or nested position with another like container.

These and other objects of the present invention are achieved in the preferred embodiments disclosed below by providing a container for storing items and adapted for being stacked upon and nested within like containers. The container includes a base. First and second pairs of spaced-apart, opposing sidewalls extend upwardly and outwardly from the base. The second pair of sidewalls is perpendicularly disposed between and interconnects the first pair of sidewalls to form a storage compartment. The container also includes first and second pairs of opposed support members. Each of the pairs of support members is pivotally connected to a respective one of the opposing sidewalls and is adapted for being moved between an inwardly-directed position residing within the storage compartment at a predetermined vertical position therein and an outwardly-directed position residing exterior to the storage compartment for defining a nesting position, a first stacking position, and a second stacking position. When in the nesting position, each of the support members is in the outwardly-directed position and in a non-interfering position relative to the storage compartment for permitting a like container to be received therein. When in the first stacking position, the first pair of the support members is in the outwardly-directed position and the second pair of the support members is in the inwardly-directed position and adapted for engaging a base of a like container in a first interfering relationship for permitting the like container to be stacked upon the second pair of support members at a first predetermined stacking height in spaced-apart relation above the base of the container. When in the second stacking position, the first pair of the support members is in the inwardly-directed position and is adapted for engaging the base of the like container in a second interfering relationship for permitting the like container to be stacked upon the first pair of support members at a second predetermined stacking height from the base of the container, wherein the second stacking height is greater than the first stacking height.

According to another preferred embodiment of the invention, each of the first pair of support members is pivotally connected to a respective one of the first pair of opposing sidewalls.

According to yet another preferred embodiment of the invention, each of the second pair of support members is pivotally connected to a respective one of the second pair of opposing sidewalls.

According to yet another preferred embodiment of the invention, the first and second pairs of support members are first and second pairs of bails, respectively, wherein each of the bails includes inwardly-turned free ends. Each of the free ends is adapted for being pivotally connected to a respective one of the opposing sidewalls.

According to yet another preferred embodiment of the invention, the container includes a pair of horizontally-extending ribs formed on an exterior surface of each of the second pair of sidewalls. The ribs define a groove extending therebetween adapted for receiving a respective one of the second pair of support members therein for maintaining the support member in the outwardly-directed position.

According to yet another preferred embodiment of the invention, the container includes a first pair of grooves defined in and extending transversely along the base between the first pair of sidewalls. Each of the grooves is adapted for receiving a respective one of a pair of support members of the like container therein for maintaining the like container in the second stacking position.

According to yet another preferred embodiment of the invention, the container includes a second pair of grooves defined in and extending transversely along the base between the second pair of sidewalls. Each of the grooves is adapted for receiving a respective one of a pair of support members of the like container therein for maintaining the like container in the first stacking position.

According to yet another preferred embodiment of the invention, each of the first pair of sidewalls includes at least one inwardly-directed projection carried thereby and adapted for engaging a respective one of the first pair of bails for maintaining the first pair of bails in the inwardly-directed position.

According to yet another preferred embodiment of the invention, the projection is a superposable ledge structure adapted for complementary engagement with a like projection on the like container for maintaining the like container in the nesting position within the storage compartment.

According to yet another preferred embodiment of the invention, each of the first pair of sidewalls defines a recess adapted for receiving a respective one of the first pair of support members therein for maintaining the support member in the outwardly-directed position.

According to yet another preferred embodiment of the invention, the container includes a plurality of bail socket members, wherein each of the bail socket members is carried by a respective one of the projections and is adapted for receiving a respective one of the free ends of the first pair of bails therein for permitting pivotal movement of each of the first pair of bails between the inwardly-directed and outwardly-directed positions.

According to yet another preferred embodiment of the invention, the container includes a bail socket connected to an upper rim of each of the second pair of sidewalls and adapted for receiving the free ends of a respective one of the second pair of bails therein for permitting the bail to move between the inwardly-directed and outwardly-directed positions.

According to yet another preferred embodiment of the invention, the container includes a plurality of holes defined by and extending through at least one of the sidewalls for providing ventilation to the storage compartment.

According to yet another preferred embodiment of the invention, the container includes a pair of handles. Each of the handles is defined by and extends through a respective one of the second pair of sidewalls adjacent the upper rim for permitting the container to be moved from one location to another.

According to yet another preferred embodiment of the invention, each of the first pair of sidewalls includes an upper rim extending along the length thereof and defining at least two ledges integrally formed therewith. Each of the ledges is adapted for receiving a respective one of the second pair of bails therein for maintaining each of the second pair of bails in the inwardly-directed position.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
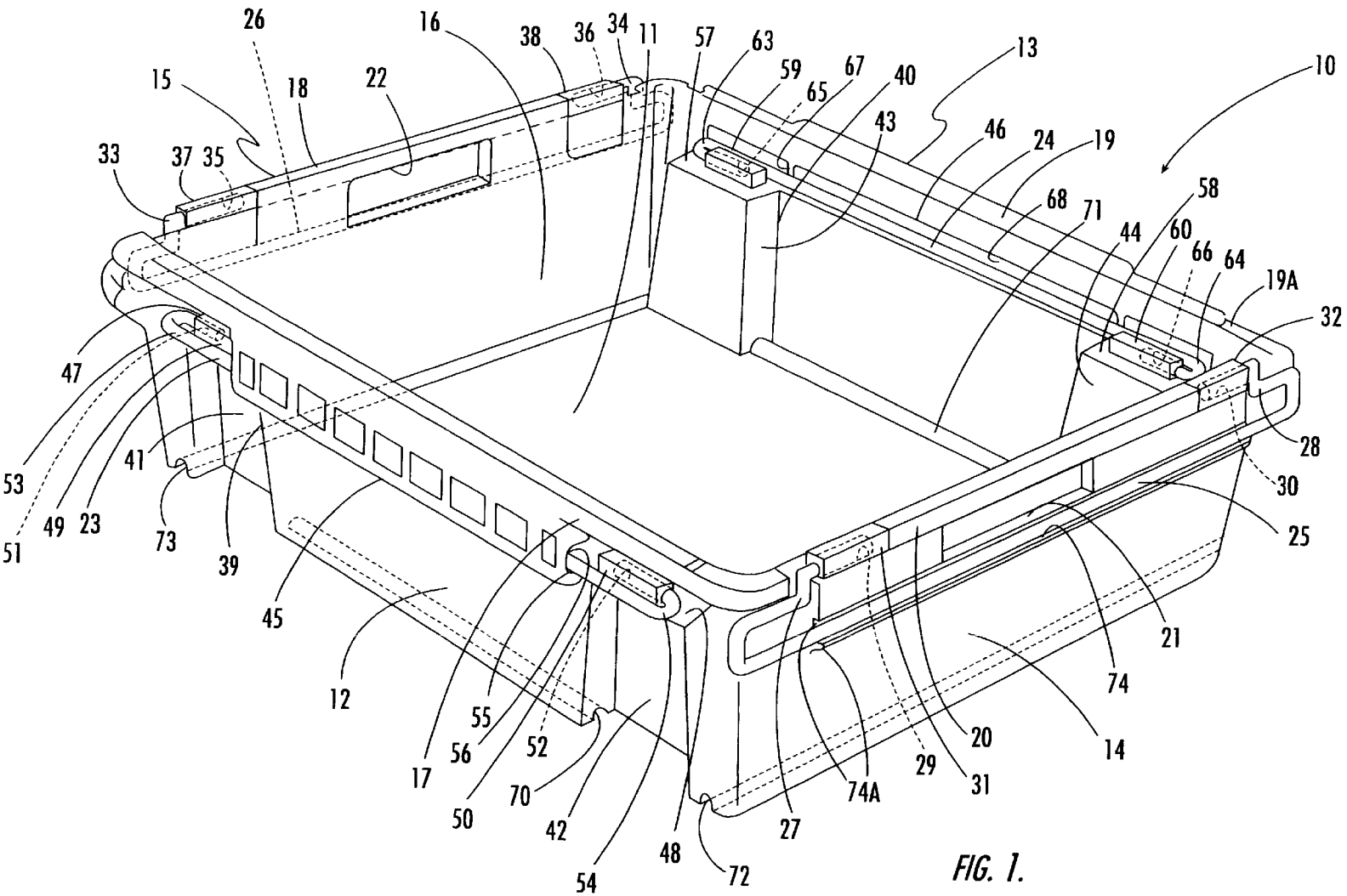
FIG. 1 is a perspective view of a stack and nest bail container according to one preferred embodiment of the invention with the stacking members in an outwardly-directed position.

Referring now specifically to the drawings, a stack and nest bail container according to the present invention is illustrated in FIG. 1 and shown generally at reference numeral 10. While the container 10 may be formed from any suitable material, the container 10 is preferably formed from either high density polyethylene or polypropylene. The container 10 may have any length, width, or height, depending upon the type of application for which the container 10 is intended to be used. As shown in FIG. 1, the container 10 includes a base 11 upon which two opposing, major sidewalls, 12 and 13, and two opposing, minor sidewalls, 14 and 15, are formed. Minor sidewalls 14and 15 are perpendicularly disposed between and interconnect major sidewalls 12 and 13, thereby defining an interior storage compartment 16. Each of the sidewalls 12, 13, 14 and 15 extends away from the base 11 at a draft angle relative to the base 11 for permitting a like container to be easily received within the storage compartment 16. Upper rim segments 17, 18, 19 and 20 are integrally formed with and extend along the length of sidewalls 12, 15, 13 and 14, respectively. Hand grip openings 21 and 22 are defined by and extend through respective minor sidewalls 14 and 15. As is shown in FIG. 1, hand grip opening 21 is located on sidewall 14 adjacent upper rim segment 20, and hand grip opening 22 is located on sidewall 15 adjacent upper rim segment 18, for permitting the container 10 to be manually transported to different positions and locations. Conventional pocket handles may alternatively be used in lieu of hand grip openings 21 and 22.

The container 10 also includes first and second pairs of bails 23, 24 and 25, 26, respectively. Each bail 23, 24, 25, and 26 is shown in FIG. 1 placed in an outwardly-directed position relative to sidewalls 12, 13, 14 and 15, respectively. As discussed in greater detail below with reference to FIG. 5, placing each bail 23, 24, 25 and 26 in the outwardly-directed position permits a like container 10' to be nested within the container 10.

As is shown in FIG. 1, bail 25 includes inwardly-turned ends 27 and 28, which are received in complementary bores 29 and 30 defined by bail sockets 31 and 32, respectively. Bail sockets 31 and 32 are connected to opposing ends of upper rim segment 20. Each bore 29 and 30 preferably has an inner diameter which is greater than the outer diameter of respective ends 27 and 28 for permitting bail 25 to pivot freely relative to bail sockets 31 and 32 between the outwardly-directed position shown in FIG. 1 and the inwardly-directed position shown in FIG. 2. Bail 26 similarly includes inwardly-turned ends 33 and 34, which are received in complementary bores 35 and 36 defined by bail sockets 37 and 38, respectively. Bail sockets 37 and 38 are connected to opposing ends of upper rim segment 18. Each bore 35 and 36 preferably has an inner diameter which is greater than the outer diameter of respective ends 33 and 34 for permitting bail 26 to pivot between the outwardly-directed position shown in FIG. 1 and the inwardly-directed position shown in FIG. 2.

Figure 2:
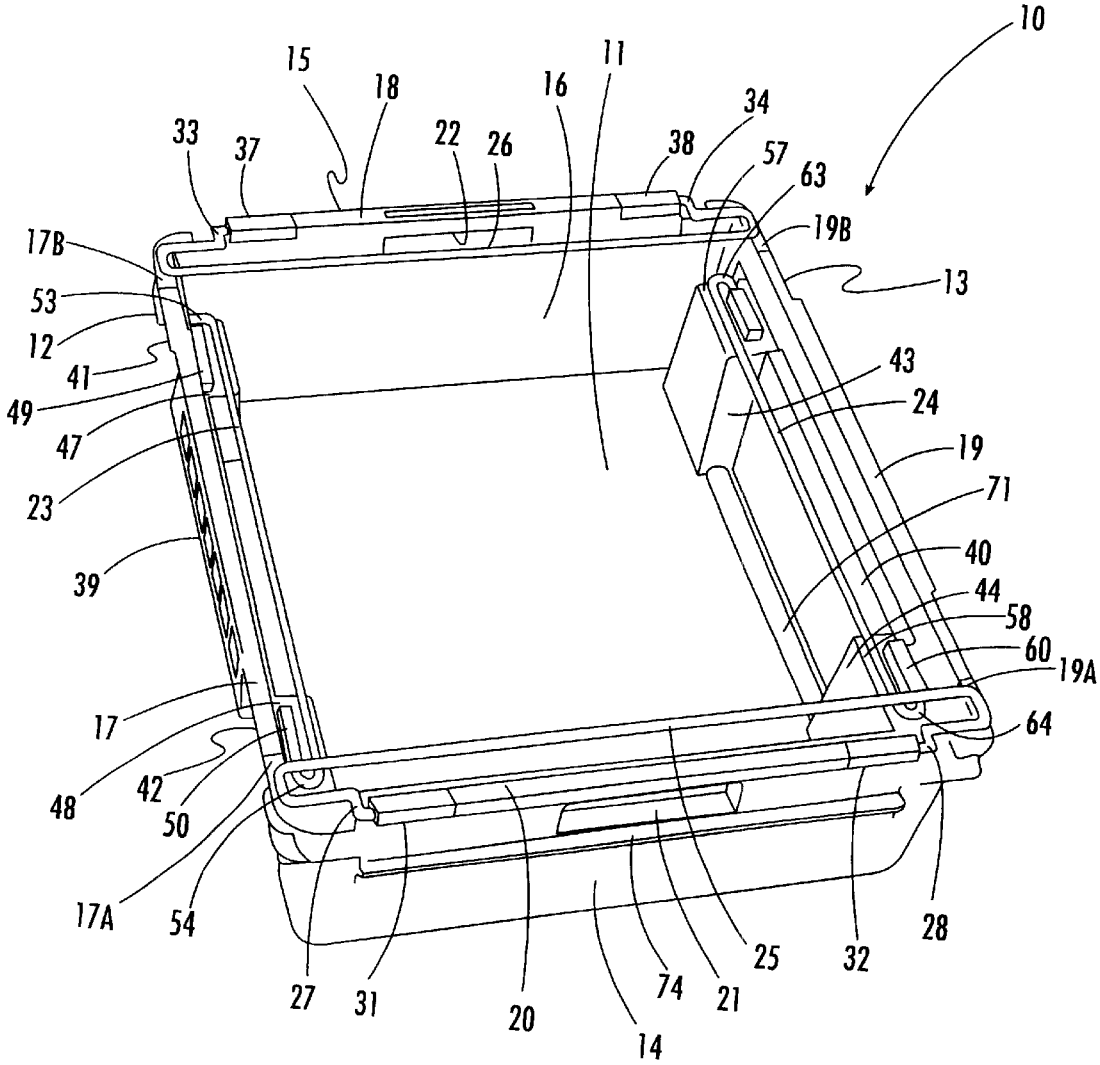
FIG. 2 is a perspective view of the stack and nest bail container shown in Figure 1 with the stacking members in an inwardly-directed position.

The container 10 also includes first and second ledge structures 39 and 40, respectively, which are integrally formed with respective major sidewalls 12 and 13. First and second ledge structures 39 and 40 include respective pairs of shoulders 41, 42 and 43, 44 and respective bail compartments 45 and 46. Shoulders 41 and 42 are positioned in spaced-apart relation to one another on sidewall 12, extend inwardly into storage compartment 16, and include respective upper faces 47 and 48. As is shown in FIG. 2, upper faces 47 and 48 engage respective ends 53 and 54 when bail 23 is in the inwardly-directed position.

Figure 3:
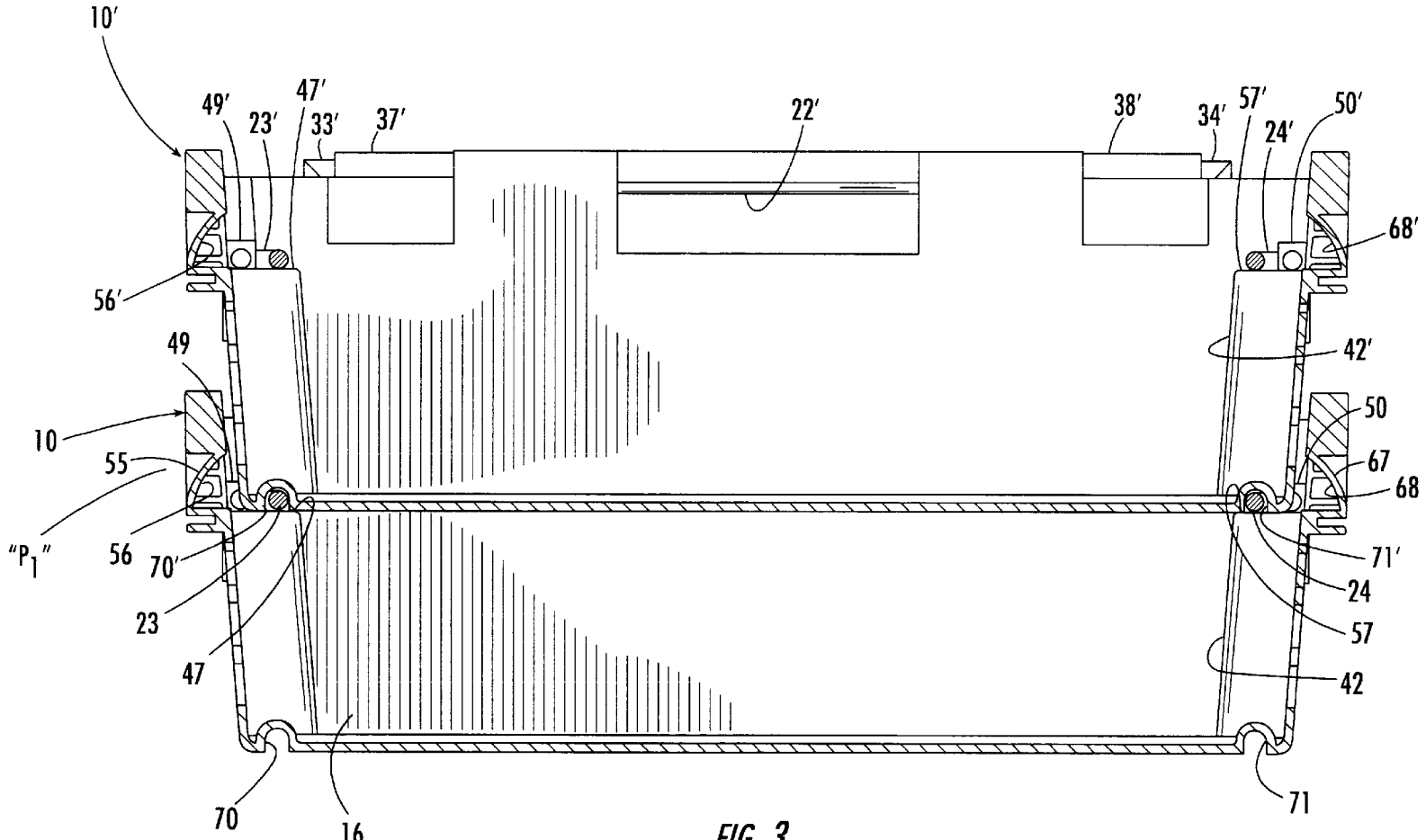
FIG. 3 is a cross-sectional side elevation of two containers according to the embodiment shown in FIG. 1 illustrating the containers oriented in one of at least two possible stacked positions.

Referring again to FIG. 1, bail compartment 45 is integrally formed with sidewall 12 and extends between shoulders 41 and 42 adjacent upper rim 17. Bail sockets 49 and 50 are connected to upper faces 47 and 48, respectively, and define complementary bores 51 and 52 into which the respective inwardly-directed ends 53 and 54 of bail 23 are received. The inner diameter of each bore 51 and 52 is preferably greater than the outer diameter of the respective ends 53 and 54 for permitting the bail 23 to pivot freely relative to bail sockets 49 and 50. Bail compartment 45 includes a curved interior sidewall 55 defining a recessed chamber 56 that extends parallel to the upper rim 17 along the length of compartment 45. As is shown in FIG. 3, the curved shape of chamber 56 is adapted to accommodate the movement of bail 23 as it pivots between the outwardly-directed position shown in FIG. 1 and the inwardly-directed position shown in FIG. 2.

Referring again to FIG. 1, shoulders 43 and 44 are positioned in spaced-apart relation to one another on sidewall 13 and extend inwardly into storage compartment 16. Shoulders 43 and 44 include respective upper faces 57 and 58, to which respective bail sockets 59 and 60 are attached. Bail sockets 59 and 60 define respective bores 65 and 66. As is shown in FIG. 1, bail 24 includes inwardly-directed ends 63 and 64 which are received within bores 65 and 66, respectively. Each bore 65 and 66 preferably has an inner diameter greater than the outer diameter of respective ends 63 and 64 for permitting bail 24 to pivot freely relative to bail sockets 59 and 60. The container 10 may alternatively be manufactured without bail sockets 49, 50, 59 and 60, and with bails 23 and 24 instead pivotally connected directly to shoulders 41, 42 and 43, 44, by positioning the bores 51, 52 and 65, 66 directly into shoulders 41, 42 and 43, 44, respectively.

Bail compartment 46 is integrally formed with sidewall 13 and extends between shoulders 43 and 44 adjacent upper rim 19. As is shown in FIG. 1, bail compartment 46 includes a curved interior wall 67 defining a recessed chamber 68 which extends parallel to upper rim 19 along the length of compartment 46. As is shown in FIG. 3, the curved shape of chamber 68 accommodates movement of the bail 24 as it pivots between the outwardly-directed position shown in FIG. 1 to the inwardly-directed position shown in FIG. 2.

Referring again to FIG. 1, the container 10 also includes a pair of stacking channels 70 and 71, which are defined in and extend along the base 11 adjacent sidewalls 12 and 13, respectively. Another pair of stacking channels 72 and 73 are defined in and extend along the base 11 adjacent respective sidewalls 14 and 15. As discussed in greater detail below with reference to FIG. 3, stacking channels 70 and 71 receive respective bails 23 and 24 of a like container for maintaining the container 10 and the like container in one of two stacking positions. As discussed in detail below within reference to FIG. 5, stacking channels 72 and 73 receive respective bails 25 and 26 of a like container for maintaining the container 10 and the like container in the other of the two stacking positions.

Figure 4:
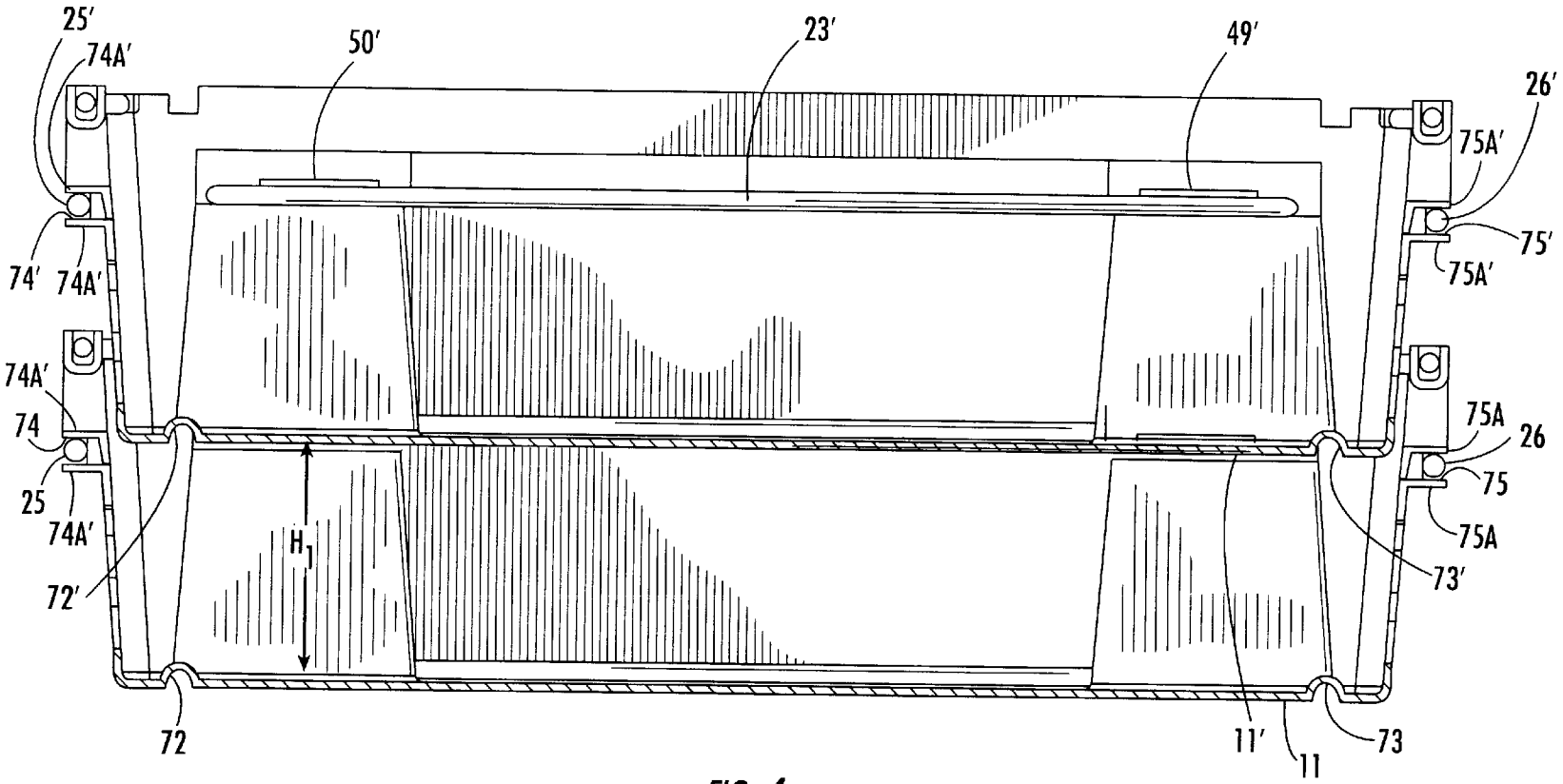
FIG. 4 is a cross-sectional side elevation of two containers according to FIG. 3 and rotated 90 degrees relative to the containers shown in FIG. 3.

The shape of ledge structures 39 and 40 and bail compartments 45 and 46, combined with the manner in which bails 23, 24, 25, and 26 are attached to the container 10, permits each bail 23, 24, 25, and 26 to be moved between inwardly and outwardly-directed positions for permitting the container 10 to be stacked upon a like container 10' at one of three preselected heights. FIG. 1 shows the container 10 with each bail 23, 24, 25, and 26 placed in the outwardly-directed position. When in the outwardly-directed position, each bail 23 and 24 is turned so that it is received within recessed chambers 56 and 68, respectively. Each bail 25 and 26 is similarly turned so that it is positioned on the outside of sidewalls 14 and 15, respectively. Bails 25 and 26 are received within and maintained in the outwardly-directed position by respective channels 74 and 75 (channel 75 is shown in FIG. 4). Channels 74 and 75 are defined by first and second pairs of ribs 74A and 75A, respectively. The first and second pairs of ribs 74A and 75A are integrally formed with sidewalls 14 and 15, respectively, and are positioned adjacent and extend parallel to respective upper edges 20 and 18.

Referring again to FIG. 2, each of the bails 23, 24, 25, and 26 is shown in its respective inwardly-directed position. When in the inwardly-directed position, bails 23 and 24 are turned so that they are placed within storage compartment 16 and engage the upper faces 47, 48 and 57, 58 of respective pairs of shoulders 41, 42 and 43, 44. Unlike bails 23 and 24, bails 25 and 26 are placed in the inwardly-directed positions by pivoting bails 25 and 26 inwardly toward the interior storage compartment 16 until they encounter upper rims 17 and 19, respectively. Specifically, ends 27 and 33 are positioned adjacent shoulders 17A and 17B, respectively, which are integrally formed with and located at opposite ends of upper rim 17. Ends 28 and 34 are similarly positioned adjacent shoulders 19A and 19B, respectively, which are integrally formed with and located at opposite ends of upper rim 19.

Referring now to FIGS. 3 through 6, positioning the bails 23, 24, 25 and 26 in a combination of inwardly and/or outwardly directed positions permits one or more like containers 10' to be stacked upon the container 10 in one of three preselected heights. Because like container 10' includes the same elements and is formed from the same materials as container 10, like elements are shown in FIGS. 3 through 6 using prime reference numerals. FIG. 3 shows the like container 10' stacked upon container 10 in a first stacking position "$P_1$" in which bails 23 and 24 are in the inwardly-directed position. Specifically, bail 23 rests upon the upper faces 47 and 48 of shoulders 41 and 42, respectively, and bail 24 rests upon upper faces 57 and 58 of shoulders 43 and 44, respectively (See also FIG. 2). As is shown in FIG. 4, when containers 10 and 10' are in the first stacking position "$P_1$", bails 25 and 26 on container 10 are each placed in the outwardly-directed position so that neither bail 25 or 26 interferes with container 10' as it is being placed within storage compartment 16 of container 10.

Referring again to FIG. 3, placing each bail 23 and 24 in the inwardly-directed position permits the bails 23 and 24 to be received within the respective complementary stacking channels 70' and 71' on the base 11' of container 10', which in turn maintains the base 11' in a stable position upon bails 23 and 24 to create a first interior stacking height "$H_1$" which extends between base 11 of container 10 and base 11' of container 10' for permitting food items and other objects to be stored within the interior storage compartment 16.

Figure 5:
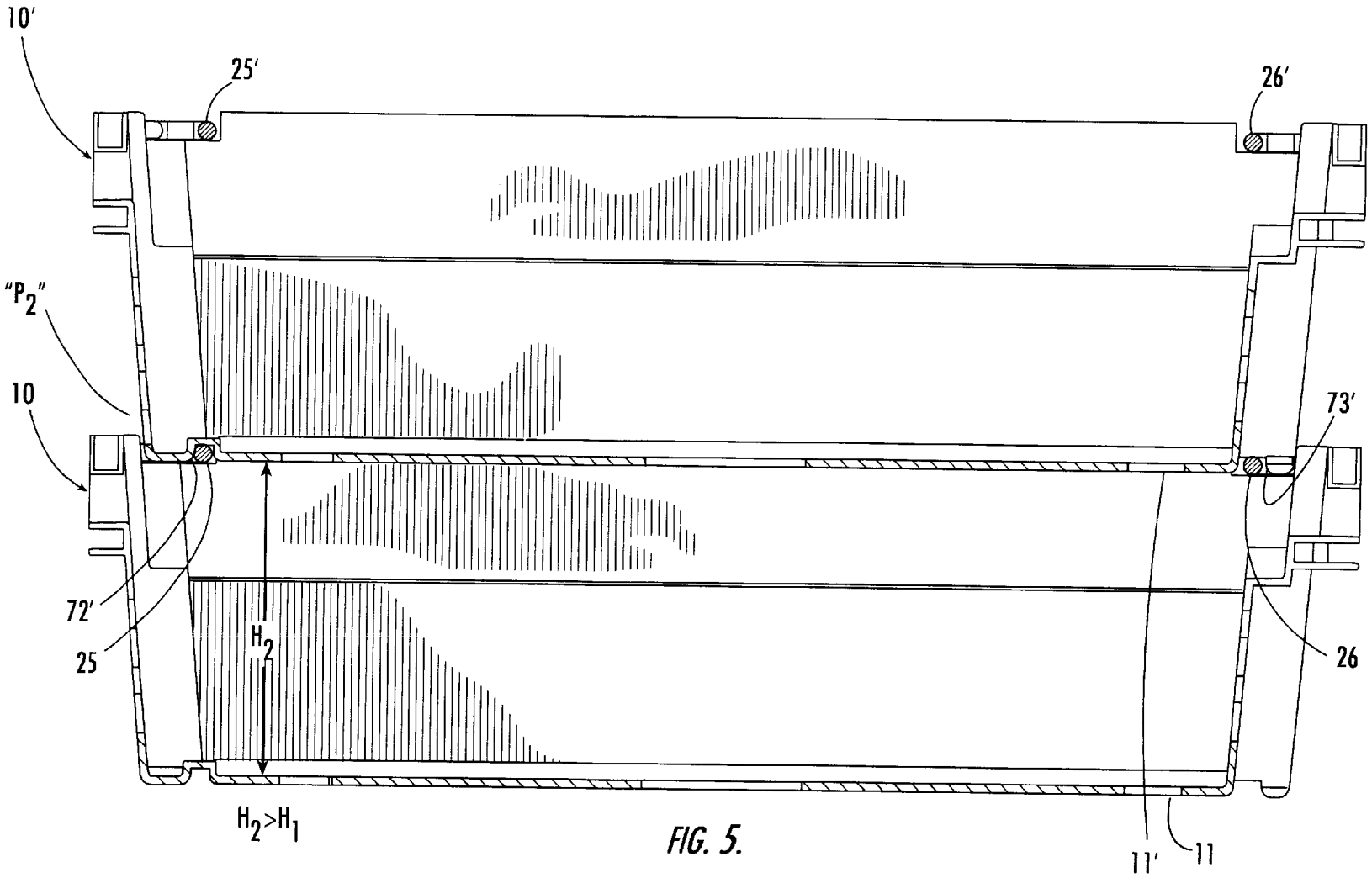
FIG. 5 is a cross-sectional side elevation of two containers according to the embodiment shown in FIG. 1 illustrating the containers oriented in another of at least two possible stacked positions.

Referring now to FIG. 5, container 10' is shown placed in a second stacking position "$P_2$" on container 10. This second stacking position "$P_2$" is achieved by moving bails 25 and 26 to the inwardly-directed position as shown. Bails 23 and 24 may remain in the inwardly-directed position (bails 23 and 24 are shown in the inwardly-directed position in FIG. 2), or may be placed in the outwardly-directed position (bails 23 and 24 are shown in the outwardly-directed position in FIG. 1). Once bails 25 and 26 are in the inwardly-directed position, container 10' may be superposed upon container 10 as shown so that bails 25 and 26 are received within and engage stacking channels 72' and 73', respectively, thereby maintaining container 10' in the second stacking position "$P_2$" so that the base 11' is placed at a second interior stacking height "$H_2$" from the base 11 of container 10 for permitting food items and other objects to be stored within the interior storage compartment 16. The first interior stacking height "$H_2$" shown in FIG. 4 is preferably less than the second interior stacking height "$H_2$" shown in FIG. 5

Figure 6:
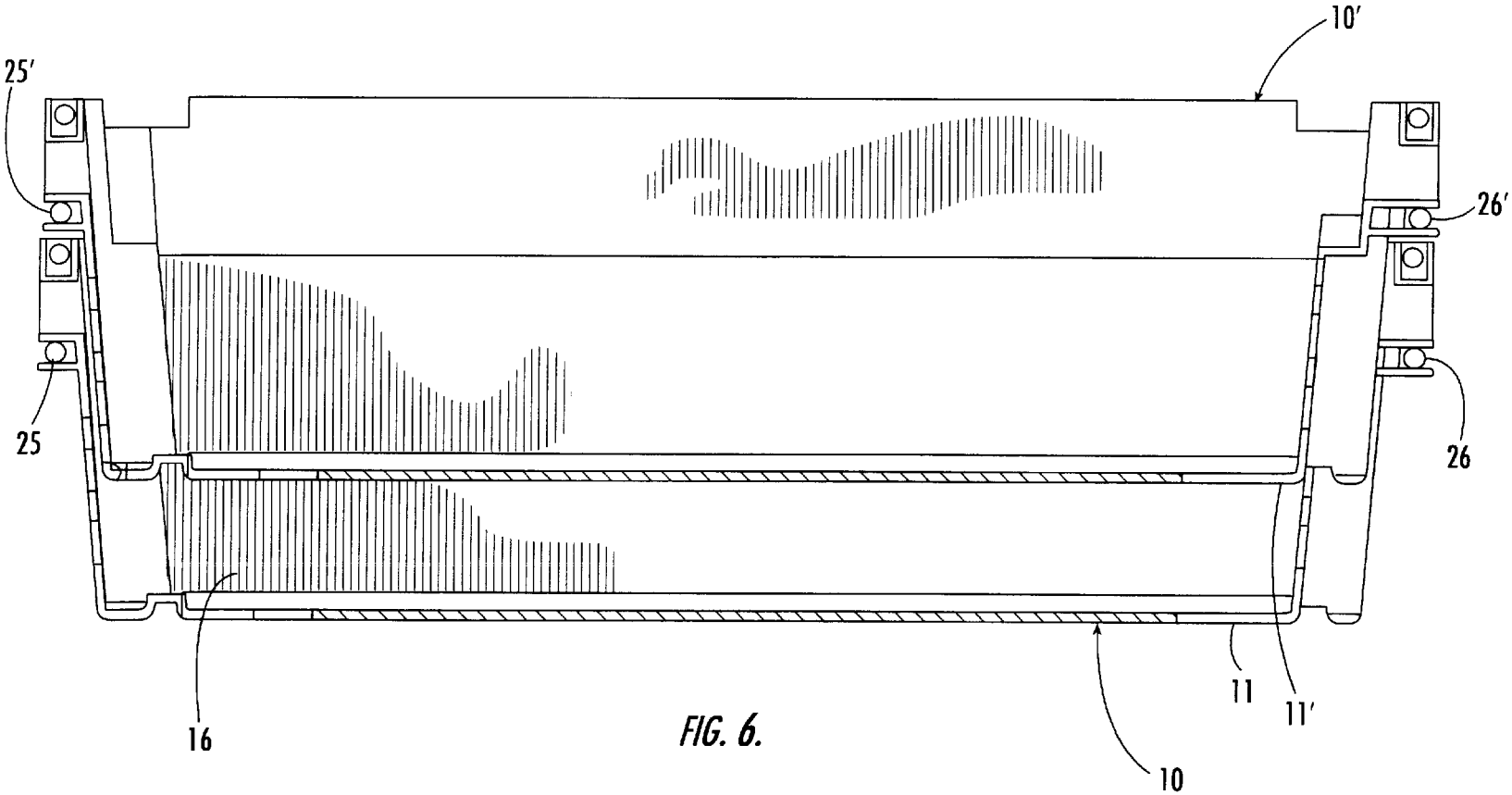
FIG. 6 is a cross-sectional side elevation of two containers according to the embodiment shown in FIG. 1 illustrating the containers in a nested position.

Referring now to FIG. 6, the container 10' is shown placed within the storage compartment 16 of container 10 in a nested position. This nested position may be achieved by placing the bails 23, 24, 25 and 26 of container 10 in the outwardly-directed position as shown in FIG. 1. Once the bails 23, 24, 25 and 26 are in the outwardly-directed position, the like container 10' is nested within the interior compartment 16 of container 10 so that the superposable surfaces of containers 10' and 10 are engaged. This nested position saves space and permits multiple like containers to be easily and cost-effectively internested together and transported when the containers are empty. While the containers 10 may be structured to internest with any possible nesting efficiency.

Figure 7:
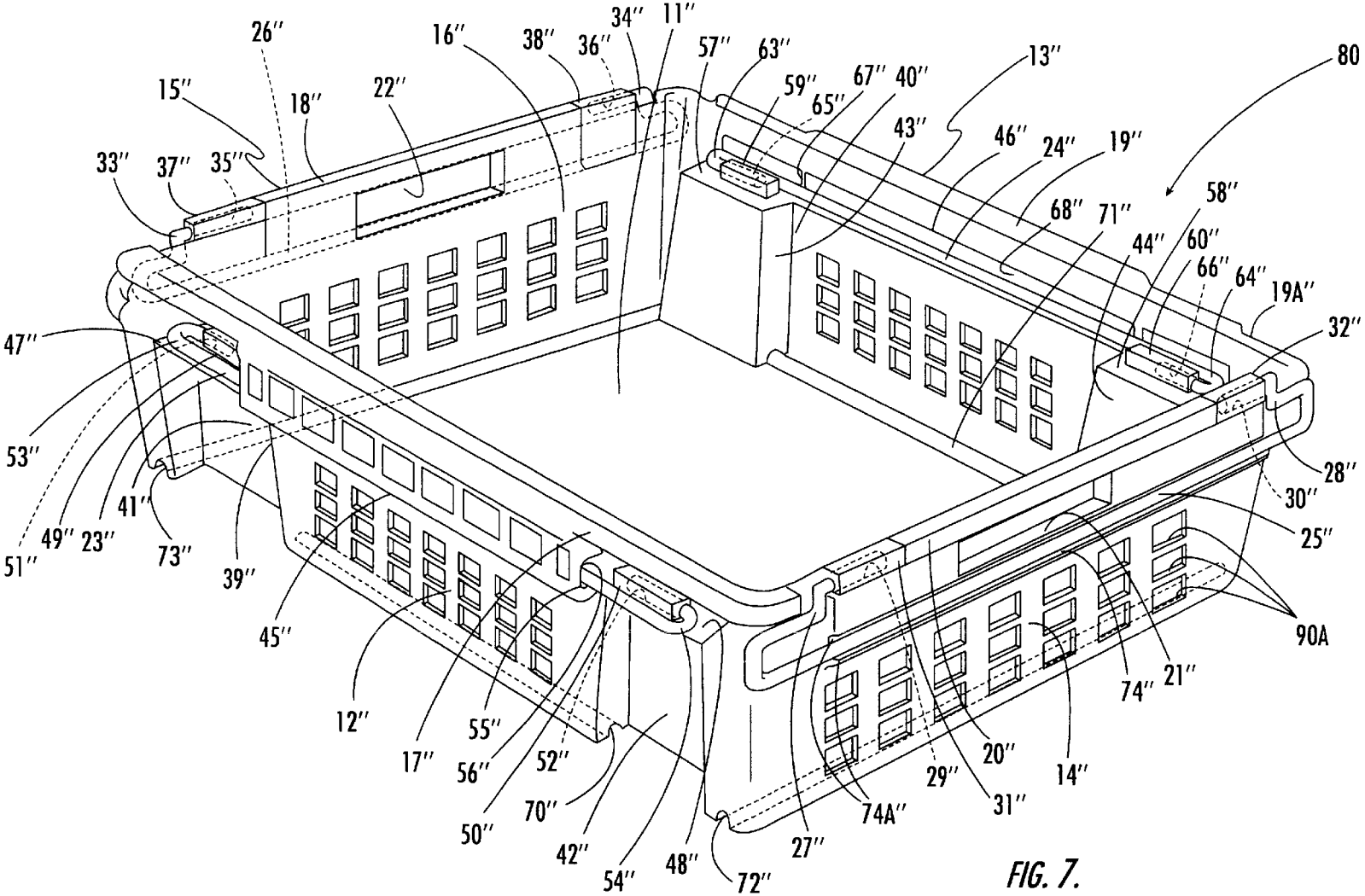
FIG. 7 is a perspective view of a stack and nest bail container according to another preferred embodiment of the invention with the stacking members in the outwardly-directed position.

Referring now to FIG. 7, a stack and nest container according to an alternative embodiment of the invention is illustrated and shown generally at reference numeral 80. Because container 80 includes the same elements and is formed from the same materials as container 10, like elements are shown using double-prime reference numerals. Furthermore, the container 80 may be internested and stacked with one or more like containers in the same manner as the container 10 shown in FIGS. 3 through 6.

As is shown in FIG. 7, the sole difference between containers 10 and 80 is that unlike container 10, container 80 includes multiple ventilation holes 90A. The ventilation holes 90A are shown in FIG. 8 defined by and extending through each of sidewalls 12", 13", 14" and 15"; however, alternative embodiments of the container 80 may include ventilation holes 90A defined by and extending through any one or more of the sidewalls 12", 13", 14" and 15" or the base 11". In addition, while each ventilation hole 90A preferably has a square shape, each ventilation hole 90A may be formed in any shape suitable to address individual ventilation requirements.

A stack and nest container has been disclosed. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

I claim:

1. A container for storing items and adapted for being stacked upon and nested within like containers, comprising:

(a) a base;

(b) first and second pairs of spaced-apart, opposing sidewalls extending upwardly and outwardly from said base, said second pair of sidewalls perpendicularly disposed between and interconnecting said first pair of sidewalls to form a storage compartment;

(c) first and second pair of opposed support members, each of said pairs of support members pivotally connected to a respective one of the opposing sidewalls and adapted for being moved between an inwardly-directed position residing within said storage compartment at a predetermined vertical position therein and an outwardly-directed position residing exterior to the storage compartment for defining:

(i) a nesting position wherein each of the support members is in said outwardly-directed position and in a non-interfering position relative to the storage compartment for permitting a like container to be received therein;

(ii) a first stacking position wherein said first pair of the support members is in the outwardly-directed position and said second pair of the support members is in the inwardly-directed position and adapted for engaging a base of a like container in a first interfering relationship for permitting the like container to be stacked upon the second pair of support members at a first predetermined stacking height in spaced-apart relation above said base of the container; and (iii) a second stacking position wherein said first pair of the support members is in the inwardly-directed position and adapted for engaging the base of the like container in a second interfering relationship for permitting the like container to be stacked upon the first pair of support members at a second predetermined stacking height from the base of the container, wherein said second stacking height is greater than said first stacking height.

2. A container according to claim 1, wherein each of said first pair of support members is pivotally connected to a respective one of said first pair of opposing sidewalls.

3. A container according to claim 1, wherein each of said second pair of support members is pivotally connected to a respective one of said second pair of opposing sidewalls.

4. A container according to claim 2 or 3, wherein said first and second pairs of support members comprise first and second pairs of bails, respectively, wherein each of said bails includes inwardly-turned free ends, each of said free ends adapted for being pivotally connected to a respective one of the opposing sidewalls.

5. A container according to claim 3, and including a pair of horizontally-extending ribs formed on an exterior surface of each of the second pair of sidewalls, said ribs defining a groove extending therebetween adapted for receiving a respective one of the second pair of support members therein for maintaining the support member in the outwardly-directed position.

6. A container according to claim 2, and including a first pair of grooves defined in and extending transversely along said base between the first pair of sidewalls, each of said first pair of grooves adapted for receiving a respective one of a pair of support members of the like container therein for maintaining the like container in the second stacking position.

7. A container according to claim 6, and including a second pair of grooves defined in and extending transversely along said base between the second pair of sidewalls, each of said second pair of grooves adapted for receiving a respective one of a pair of support members of the like container therein for maintaining the like container in the second stacking position.

8. A container according to claim 4, wherein each of the first pair of sidewalls includes at least one inwardly-directed projection carried thereby and adapted for engaging a respective one of the first pair of bails for maintaining the first pair of bails in the inwardly-directed position.

9. A container according to claim 8, wherein said projection comprises a superposable ledge structure adapted for complementary engagement with a like projection on the like container for maintaining the like container in said nesting position within the storage compartment.

10. A container according to claim 8, wherein each of said first pair of sidewalls defines a recess adapted for receiving a respective one of the first pair of support members therein for maintaining the support member in the outwardly-directed position.

11. A container according to claim 8, and including a plurality of bail socket members, wherein each of said bail socket members is carried by a respective one of said projections and is adapted for receiving a respective one of said free ends of the first pair of bails therein for permitting pivotal movement of each of the first pair of bails between the inwardly-directed and outwardly-directed positions.

12. A container according to claim 8, and including a bail socket connected to an upper rim of each of the second pair of sidewalls and adapted for receiving the free ends of a respective one of the second pair of bails therein for permitting the bail to move between the inwardly-directed and outwardly-directed positions.

13. A container according to claim 1, and including a plurality of holes defined by and extending through at least one of the sidewalls for providing ventilation to the storage compartment.

14. A container according to claim 12, and including a pair of handles, each of said handles defined by and extending through a respective one of the second pair of sidewalls adjacent said upper rim for permitting the container to be moved from one location to another.

15. A container according to claim 4, wherein each of the first pair of sidewalls includes an upper rim extending along the length thereof and defining at least two grooves therein, each of said grooves having a shape complementary to and adapted for receiving a respective one of the second pair of bails therein for maintaining each of the second pair of bails in the inwardly-directed position.

* * * * *